US005479857A

United States Patent [19]

Braun

[11] Patent Number: 5,479,857

[45] Date of Patent: Jan. 2, 1996

[54] CLEANING DEVICE FOR CYLINDERS OF A PRINTING PRESS

[75] Inventor: Michael Braun, Speyer, Germany

[73] Assignee: Heidelberger Druckmaschinen AG, Heidelberg, Germany

[21] Appl. No.: 228,683

[22] Filed: Apr. 18, 1994

[30] Foreign Application Priority Data

Apr. 16, 1993 [DE] Germany ..... 43 12 420.8

[51] Int. Cl.[6] ..... B41F 35/06

[52] U.S. Cl. ..... 101/423; 101/425

[58] Field of Search ..... 101/423, 425, 101/424

[56] References Cited

U.S. PATENT DOCUMENTS

| | | | |
|---|---|---|---|
| 4,555,989 | 12/1985 | Marass et al. | 101/424 |
| 4,981,078 | 1/1991 | Dettinger et al. | 101/425 |
| 5,150,653 | 9/1992 | Hara | 101/483 |

FOREIGN PATENT DOCUMENTS

| | | |
|---|---|---|
| 0315144 | 5/1989 | European Pat. Off. . |
| 0520521 | 12/1992 | European Pat. Off. . |
| 2046602 | 6/1972 | Germany . |
| 2458772 | 6/1976 | Germany . |
| 2538105 | 6/1978 | Germany . |
| 3-114748 | 5/1991 | Japan . |
| 1502466 | 3/1978 | United Kingdom . |
| 1525255 | 9/1978 | United Kingdom . |
| 2222552 | 3/1990 | United Kingdom . |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Cleaning device for cylinders of a printing press having a cleaning cloth which is unwound from a replaceable supply roll on a clean-cloth spindle, guided over a pressure pad movable towards the circumference of a cylinder, and wound onto a soiled-cloth spindle, and a reversible drive for feeding the cleaning cloth in sections and partially retransporting the cleaning cloth, as well as rewinding the cleaning cloth from the soiled-cloth spindle onto the supply roll of the clean-cloth spindle, includes an electric motor electronically controllable so as to be reversible in direction of rotation, a gear wheel drivingly connected to the electronically controllable electric motor so as to be reversible in direction of rotation with the electric motor, a gear wheel drivingly connected to the clean-cloth spindle, a gear wheel drivingly connected to the soiled cloth spindle, and a coupling device automatically activatable for selectively bringing the gear wheel reversible in direction of rotation alternatively into meshing engagement with the gear wheel drivingly connected to the clean-cloth spindle and with the gear wheel drivingly connected to the soiled-cloth spindle when the direction of rotation of the electric motor is reversed.

8 Claims, 3 Drawing Sheets

CLEANING DEVICE FOR CYLINDERS OF A PRINTING PRESS

SPECIFICATION

Figure 1:
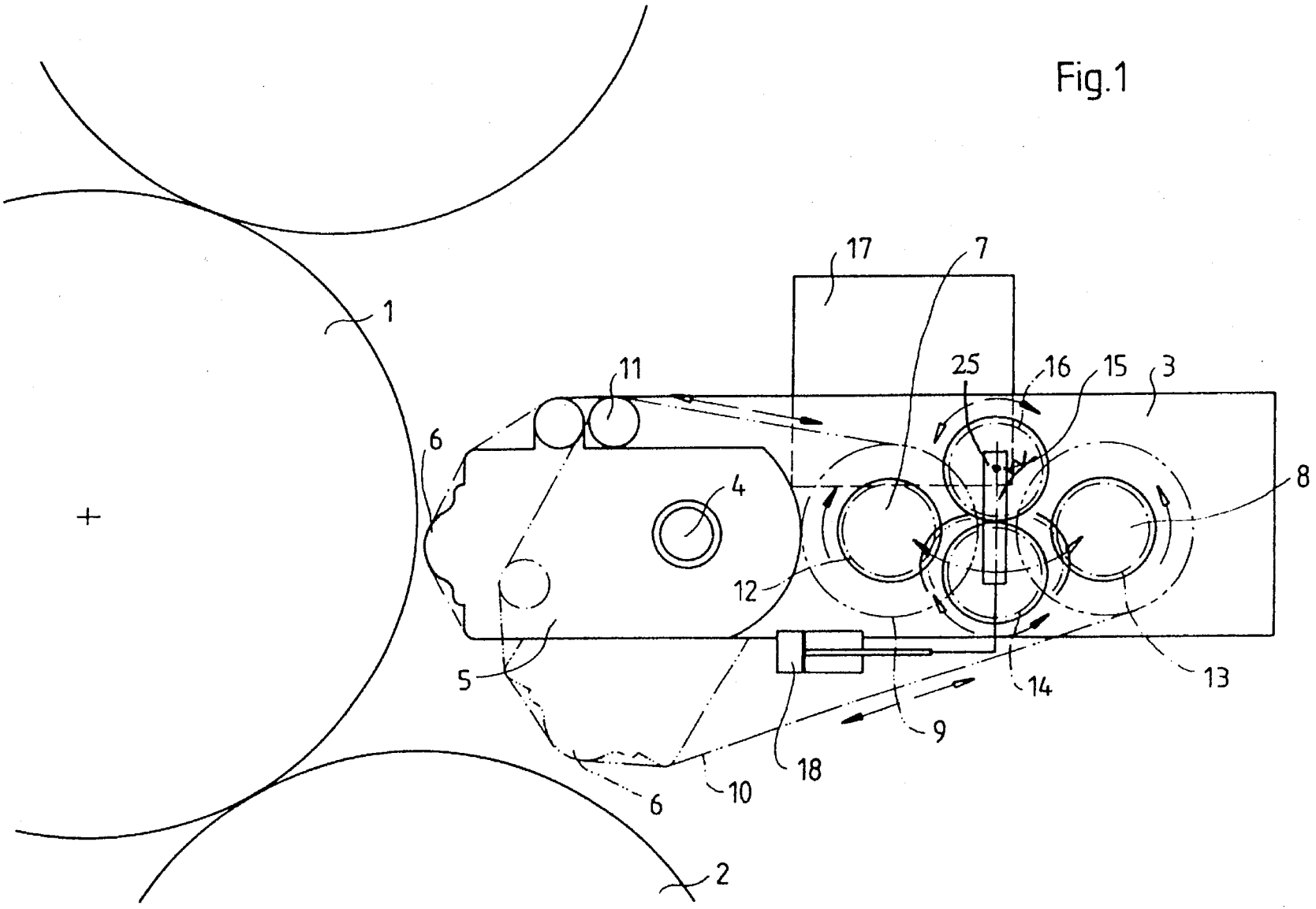

The invention relates to a cleaning device for cylinders of a printing press and, more particularly, to such a cleaning device having a cleaning cloth which is unwound from a replaceable supply roll on a clean-cloth spindle, guided over a pressure pad movable towards the circumference of a cylinder, and wound onto a soiled-cloth spindle, and reversible drive means for feeding the cleaning cloth in sections and partially re-transporting the cleaning cloth, as well as rewinding the cleaning cloth from the soiled-cloth spindle onto the supply roll of the clean-cloth spindle. The invention relates especially to a cleaning device for a blanket cylinder and an impression cylinder of an offset printing press with such generic features.

A device of this general type exemplary of the state of the art is disclosed in published German Patent Document 38 41 260 A1. Shown therein is a cleaning device including a pressure pad of elastic material arranged within a frame of a slide-in unit or module which is movable towards the circumference of a cylinder, and a clean-cloth shaft or spindle as well as a soiled-cloth shaft or spindle mounted so as to be drivable by an electric motor, a clean cloth unwinding from a replaceable supply roll on the clean-cloth shaft being guided around the outer surface of the pressure pad and, after having been used, being wound onto the dirty-cloth spindle. From this German patent document, it has also become known heretofore to wind or spool back the used cleaning cloth from the soiled-cloth spindle onto the supply roll on the clean-cloth spindle by means of a reversible drive, so that the pressman or other operator needs only to replace one cloth roll when the clean cloth has been used up. The two spindles of the heretofore known cleaning device are connected with electromotive drives having electronic control programs by means of which each advancing or feed movement of the cleaning cloth for each cleaning procedure is limited to a predetermined section of the cleaning cloth, and the latter is partially spooled back after the cleaning procedure is completed, so that the section least soiled while in the end phase of the cleaning procedure can be used again for precleaning in the next cleaning procedure, thereby economizing on the use of the cloth. The drive means are made up of separate electric motors and an electronic control system for the advancing or feeding and for the rewinding or respooling of the cleaning cloth. More specifically, such drive means are described as several motors disclosed in detail in published European Patent Document (EP) 0 315 144 A2 and in U.S. Pat. No. 5,125,342 including somewhat similar contents.

From published European Patent Document (EP) 0 334 173 A1, a cleaning device has become known heretofore wherein a press pad for the cleaning cloth is swivellable out of a pressure position on the blanket cylinder and into a pressure position on the impression cylinder and swivellable back, so that both cylinders can be cleaned with the same cleaning device (note page 2, lines 42 and 43 of the European patent document).

The alternative drive of both the clean-cloth spindle as well as the soiled-cloth spindle by only one electric motor has become known heretofore from published European Patent Document (EP) 0 520 521 A1. This is made possible by arranging a gear wheel on the clean-cloth spindle and a gear wheel on the soiled-cloth spindle so that they are axially offset with respect from one another, and the gear wheels are selectively bringable into engagement with an axially displaceable gear wheel. There is no mention, much less description, in this published European patent document of any means for causing this change-over of gear-wheel engagements.

It is accordingly an object of the invention of the instant application to provide a cleaning device for cylinders of a printing press and, more particularly, such a cleaning device having a motorized drive for transporting a cleaning cloth therein by simplified means.

With the foregoing and other objects in view, there is provided, in accordance with the invention, a cleaning device for cylinders of a printing press having a cleaning cloth which is unwound from a replaceable supply roll on a clean-cloth spindle, guided over a pressure pad movable towards the circumference of a cylinder, and wound onto a soiled-cloth spindle, and reversible drive means for feeding the cleaning cloth in sections and partially re-transporting the cleaning cloth, as well as rewinding the cleaning cloth from the soiled-cloth spindle onto the supply roll of the clean-cloth spindle, comprising an electric motor electronically controllable so as to be reversible in direction of rotation, a gear wheel drivingly connected to the electronically controllable electric motor so as to be reversible in direction of rotation with the electric motor, a gear wheel drivingly connected to the clean-cloth spindle, a gear wheel drivingly connected to the soiled cloth spindle, and coupling means automatically activatable for selectively bringing the gear wheel reversible in direction of rotation alternatively into meshing engagement with the gear wheel drivingly connected to the clean-cloth spindle and with the gear wheel drivingly connected to the soiled-cloth spindle when the direction of rotation of the electric motor is reversed.

In accordance with another feature of the invention, the electric motor has a drive shaft, and the gear wheel drivingly connected so as to be reversible in direction of rotation is arranged so as to be axially slidable against spring force on the shaft, and the coupling means comprise an axial-cam guide by means of which the gear wheel drivingly connected so as to be reversible in direction of rotation is alternatively engageable with the gear wheels drivingly connected to the clean-cloth and soiled-cloth spindles, respectively.

In accordance with a further feature of the invention, the axial-cam guide is formed on the circumference of the drive shaft of the electric motor, and the coupling means also includes a slide member on the gear wheel drivingly connected so as to be reversible in direction of rotation, the slide member engaging in the axial-cam guide.

In accordance with an added feature of the invention, the gear wheels drivingly connected to the clean-cloth spindle and the soiled-cloth spindle, respectively, are axially offset from one another.

In accordance with an additional feature of the invention, the cleaning device includes a rocker arm pivotable about a fixed axis of rotation, a gear wheel rotatably mounted on the fixed axis of rotation, a gear wheel mounted on the rocker arm and being in continuous meshing engagement with the gear wheel rotatably mounted on the fixed axis of rotation, the coupling means being controllable by the reversal in the direction of rotation of the electric motor for swivelling the gear wheel mounted on the rocker arm alternatively into meshing engagement with the gear wheels drivingly connected to the clean-cloth and soiled-cloth spindles, respectively.

In accordance with yet another feature of the invention, means are provided for controlling the drive for the gear wheel reversible in direction of rotation of the electric motor and are integrated in an electronic control system for a drive for transporting the cleaning cloth.

In accordance with yet a further feature of the invention, the means for swivelling the gear wheel mounted on the rocker arm include a pneumatic cylinder.

In accordance with an added feature of the invention, the pressure pad is arranged in a swivel head, the swivel head being swivellable about a swivel axis extending parallel to the axes of the printing-press cylinders from a pressure position for the cleaning cloth on the blanket cylinder to a pressure position for the cleaning cloth on the impression cylinder and, in reverse, from a pressure position on the impression cylinder to a pressure position on the blanket cylinder, the swivel axis of the swivel head being spaced substantially equidistantly from the circumference of both the blanket and the impression cylinders, respectively.

In accordance with a concomitant feature of the invention, the printing press has a press frame formed with side walls, and the cleaning device includes bearings for the clean-cloth spindle and the soiled-cloth spindle arranged in the side walls of the press frame.

In a preferred construction, the cleaning device according to the invention includes a first gear wheel which is movably mounted on a shaft so as to be axially slidable, and second and third gear wheels, respectively, fastened to a clean-cloth spindle and a soiled-cloth spindle, are axially offset with respect to one another in a conventional manner, so that the first gear wheel, by axial displacement thereof, can selectively meshingly engage with the respective second and third gear wheels when the direction of rotation is reversed, the axial displacement of the first gear wheel being caused by automatic coupling means.

In another embodiment, a movably mounted gear wheel is supported on a rocker arm which is movable about the axis of rotation of the electric motor, the movably mounted gear wheel being in continuous meshing engagement with a gear wheel arranged on the motor shaft. In this way, the gear wheel movably mounted on the rocker arm can selectively be brought into meshing engagement with the gear wheel arranged on the clean-cloth spindle and with the gear wheel arranged on the soiled-cloth spindle, respectively.

With the constructions according to the invention there is provided a simplified electronic control system or program for the electric motor to drive the clean-cloth spindle and the soiled-cloth spindle so as to effect a reduced usage of cleaning cloth. The drive of a conventional electric motor is equipped with an electronic control program which effects an advance or feed of a sufficient section-length of cleaning cloth for one cleaning action, and after completion of the cleaning procedure effects a partial rewinding of the cleaning cloth, so that the portion of the cleaning cloth which has been soiled only relatively slightly in the last section of the respective preceding cleaning action or operation can be used again for precleaning in the following cleaning action or operation. In order thereby to achieve a constantly uniform advance or feed of the cleaning cloth and a continuously maintained uniform length of a rewind section thereof, regardless of changes in diameter of both cloth rolls, adjustments can be performed through the electronic drive control of the drive motor. Sensors determine in a conventional manner the actual usage or consumption of the cleaning cloth, and switch the control of the drive motor to reverse operation, so that the used cleaning cloth is spooled back or rewound from the soiled-cloth spindle to the clean-cloth spindle, and only one cleaning-cloth roll needs to be replaced by the pressman or other operator.

Other features which are considered as characteristic for the invention are set forth in the appended claims.

Although the invention is illustrated and described herein as embodied in a cleaning device for cylinders of a printing press, it is nevertheless not intended to be limited to the details shown, since various modifications and structural changes may be made therein without departing from the spirit of the invention and within the scope and range of equivalents of the claims.

Figure 2:
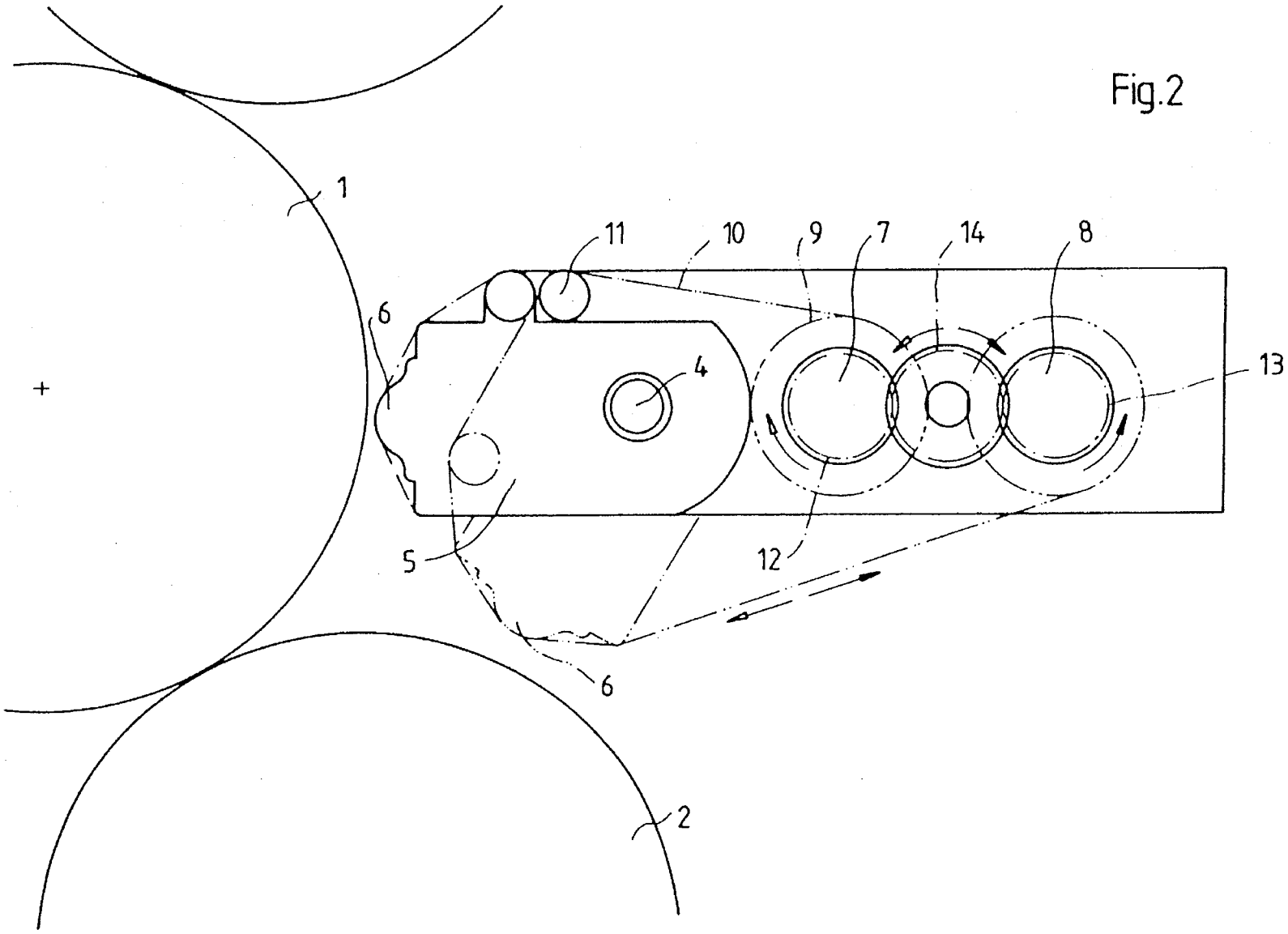
Figure 3:
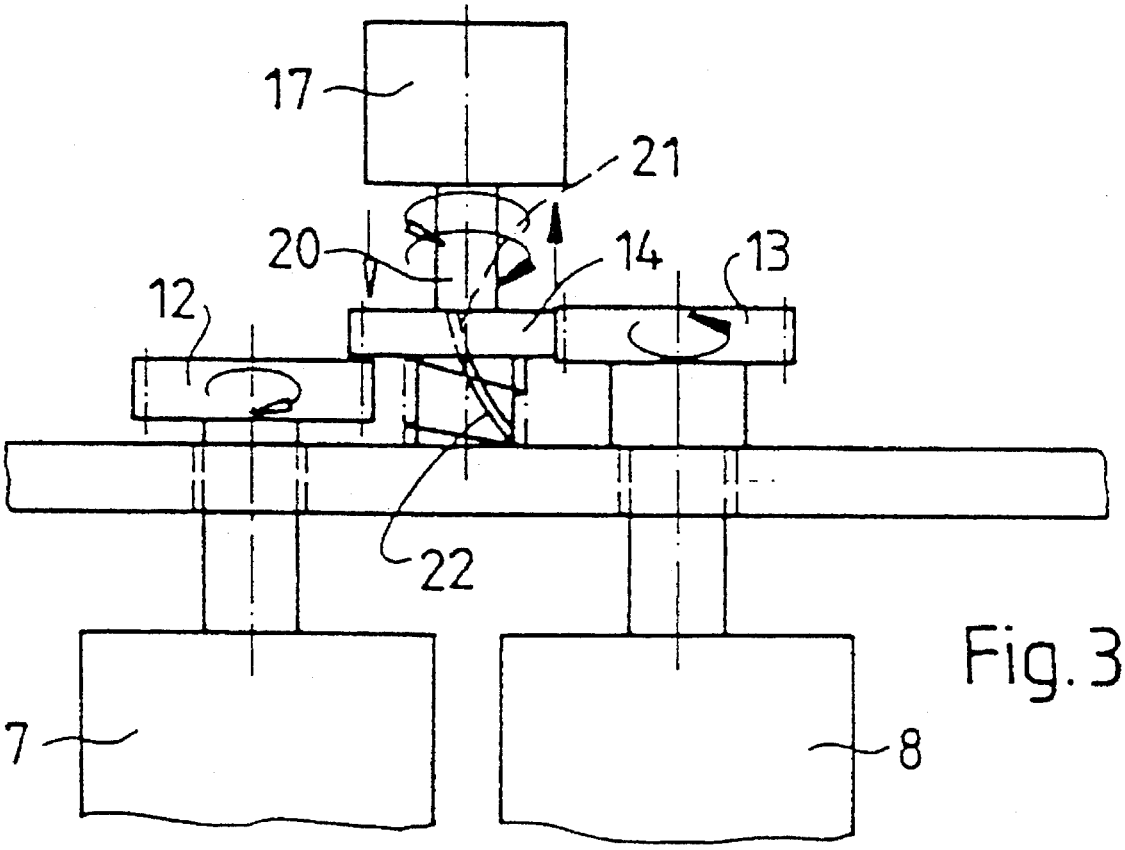

The construction and method of operation of the invention, however, together with additional objects and advantages thereof will be best understood from the following description of specific embodiments when read in connection with the accompanying drawings, in which:

FIGS. 1 and 2 are a diagrammatic side elevational view of two different embodiments of the cleaning device according to the invention; and FIG. 3 is a fragmentary top plan view of FIG. 2 showing the end of the two spindles at the drive side of the cleaning device.

Referring now to the drawings and, first, particularly to FIGS. 1 and 2 thereof, there are shown therein two different exemplary embodiments of the cleaning device for both cleaning a blanket cylinder 1 and, simultaneously, an impression cylinder 2 of an otherwise non-illustrated printing unit of an offset printing press. At a front end of a frame 3, as shown in FIG. 1, for example, constructed as an insert or slide-in unit or module, there is mounted a swivel head 5 which is movable about a swivel axis 4. At an end of the swivel head 5 directed towards the printing unit, a pressure pad 6 is arranged in the swivel head 5 and is formed, for example, of a linearly movable pressure stamp of elastic material or of a membrane wall of a chamber which is subjectible to an application of pressurized air therein. The manner, i.e., the angle, at which the swivel head 5 is mounted on the swivel axis 4 permits an alignment of the pressure stamp 6 with respect to the circumference of the blanket cylinder 1 and, with a change in the swivelled position of the swivel head 5, also permits an alignment with respect to the circumference of the impression cylinder 2, so that both cylinders 1 and 2 can be cleaned with the same cleaning device. The swivel axis 4, therefore, is situated somewhat equidistant from the circumference of the blanket cylinder 1 and the circumference of the impression cylinder 2. A clean-cloth spindle 7 and a soiled-cloth spindle 8 are mounted by respective ends thereof in bearings 23 and 24 within the frame 3 (note FIG. 3). The centers of the axes of the clean-cloth spindle 7 and the soiled-cloth spindle 8 as well as the center of the swivel axis 4 are disposed in one plane. From a supply roll 9 slippable onto the clean-cloth spindle 7, a cleaning cloth 10 guided by guide rollers 11 runs around the outer surface of the pressure pad 6 to the soiled-cloth spindle 8, so that the cleaning cloth 10 is windable onto the soiled-cloth spindle 8 yet is also transportable back and again windable onto the supply roll 9 on the clean-cloth spindle 7.

For the electronically controlled drive to advance or feed the cleaning cloth 10 from the supply roll 9 on the clean-cloth spindle 7 to the soiled-cloth spindle 8 and for a partial rewinding or retransport of the cleaning cloth 10 after each cleaning procedure, a gear wheel 12 is provided on the clean-cloth spindle 7, as well as a gear wheel 13 on the soiled-cloth spindle 8.

In the embodiment shown in FIG. 1, another gear wheel 14 is rotatably mounted at one end of a rocker arm 15 or the like provided between the gear wheels 12 and 13, so that this gear wheel 14 can be selectively brought into engagement by the toothing thereof with the toothing of the gear wheel 12 or the toothing of the gear wheel 13. The other end of the rocker arm 15 is mounted in the frame 3 on a shaft 25 defining a fixed axis of rotation about which the rocker arm 15 is pivotable, and another gear wheel 16 driven by an electric motor 17 is also mounted on the last-mentioned shaft, the gear wheel 16 having toothing which is in continuous engagement with the toothing of the gear wheel 14. When the direction of advancement or feed of the cleaning cloth 10 is reversed by a reversal in the rotating direction of the electric motor 17, a pneumatic cylinder 18 controlled by the electronic control means for the electric motor 17 and having a piston rod connected to the rocker arm 15 causes a swivelling movement of the rocker arm 15, so that the gear wheels 14 and 12 become disengaged and, instead, the gear wheels 14 and 13 become engaged or, in reverse, so that the gear wheels 14 and 13 become disengaged and, instead, the gear wheels 14 and 12 become engaged.

The embodiment of the cleaning device according to FIGS. 2 and 3 differs from the embodiment according to FIG. 1 in that the gear wheel 14 is movably mounted so as to be slidable axially on a shaft 20 which is disposed between the gear wheel 12 fastened on the clean-cloth spindle 7 and the gear wheel 13 fastened on the soiled-cloth spindle 8, the two gear wheels 12 and 13 on spindles 7 and 8, respectively, being arranged axially offset with respect to one another. Thus, by an axial displacement of the gear wheel 14, an engagement thereof with the gear wheel 12 or, as shown in FIG. 3, with the gear wheel 13 can selectively take place. This axial displacement of the gear wheel 14 is effected by an axial-cam guide operative between the gear wheel 14 and the shaft 20 of the electric motor 17 when the direction of rotation is reversed; the axial-cam guide being effective in a direction opposite to the force of a spring 19, so that the spring 19 causes the gear wheel 14 to slide back automatically into the other end position when the direction of rotation is reversed again. The axial-cam guide is formed of a slide member 21 disposed in the hub of the gear wheel 14 and engaging in an axial cam 22 of limited length on the circumference of the shaft 20 of the electric motor 17, so that torque transmission takes place only in the end positions of the slide member 21 or the like in the axial cam 22. This construction enables the movably mounted gear wheel 14 to be positioned directly on the axially slidable shaft or armature 20 of the electric motor 17.

A common feature of both of the exemplary embodiments of the invention is that the parts of the cleaning device may also be mounted directly in the side walls of the press frame. The structural features of the invention may, thus, also be applied to cleaning devices of different types of construction which are not suited as insert or slide-in units or modules.

I claim:

1. Cleaning device for cylinders of a printing press having a cleaning cloth which is unwound from a replaceable supply roll on a clean-cloth spindle, guided over a pressure pad movable towards the circumference of a cylinder, and wound onto a soiled-cloth spindle, and reversible drive means for feeding the cleaning cloth in sections and partially re-transporting the cleaning cloth, as well as rewinding the cleaning cloth from the soiled-cloth spindle onto the supply roll of the clean-cloth spindle, comprising a single electric motor electronically controllable so as to be reversible in direction of rotation, a gear wheel drivingly connected to said single electronically controllable electric motor so as to be reversible in direction of rotation with said electric motor, a gear wheel drivingly connected to the clean-cloth spindle, a gear wheel drivingly connected to the soiled cloth spindle, and coupling means automatically activatable for selectively bringing said gear wheel reversible in direction of rotation alternatively into meshing engagement with said gear wheel drivingly connected to the clean-cloth spindle and with said gear wheel drivingly connected to the soiled-cloth spindle when the direction of rotation of the single electric motor is reversed, said coupling means comprising an axial-cam guide by means of which said gear wheel is drivingly connected so as to be reversible in direction of rotation and alternatively engageable with said gear wheels drivingly connected to the clean-cloth and soiled-cloth spindles, respectively.

2. Cleaning device according to claim 1, wherein said single electric motor has a drive shaft, and including spring means for applying a spring force in axial direction of said drive shaft, said gear wheel drivingly connected so as to be reversible in its direction of rotation and being arranged so as to be axially slidable against said spring force on said shaft.

3. Cleaning device according to claim 2, wherein said axial-cam guide is formed on the circumference of said drive shaft of said single electric motor, and said coupling means also include a slide member on said gear wheel drivingly connected so as to be reversible in direction of rotation, said slide member engaging in said axial-cam guide.

4. Cleaning device according to claim 2, wherein said gear wheels drivingly connected to the clean-cloth spindle and the soiled-cloth spindle, respectively, are axially offset from one another.

5. Cleaning device for cylinders of a printing press having a cleaning cloth which is unwound from a replaceable supply roll on a clean-cloth spindle, guided over a pressure pad movable towards the circumference of a cylinder, and wound onto a soiled-cloth spindle, and reversible drive means for feeding the cleaning cloth in sections and partially re-transporting the cleaning cloth, as well as rewinding the cleaning cloth from the soiled-cloth spindle onto the supply roll of the clean-cloth spindle, comprising a single electric motor electronically controllable so as to be reversible in direction of rotation, a gear wheel drivingly connected to said single electronically controllable electric motor so as to be reversible in direction of rotation with said electric motor, a gear wheel drivingly connected to the clean-cloth spindle, a gear wheel drivingly connected to the soiled cloth spindle, and coupling means automatically activatable for selectively bringing said gear wheel reversible in direction of rotation alternatively into meshing engagement with said gear wheel drivingly connected to the clean-cloth spindle and with said gear wheel drivingly connected to the soiled-cloth spindle when the direction of rotation of the single electric motor is reversed, said coupling means including a rocker arm pivotable about a fixed axis of rotation, a gear wheel rotatably mounted on said fixed axis of rotation, a gear wheel mounted on said rocker arm and being in continuous meshing engagement with said gear wheel rotatably mounted on said fixed axis of rotation, said coupling means including means responsive to the reversal in the direction of rotation of said electric motor for swivelling said gear wheel mounted on said rocker arm alternatively into meshing engagement with said gear wheels drivingly connected to the clean-cloth and soiled-cloth spindles, respectively.

6. Cleaning device according to claim 5, wherein said means for swivelling said gear wheel mounted on said rocker arm include a pneumatic cylinder.

7. Cleaning device according to claim 1, wherein the printing-press cylinders include a blanket cylinder and an impression cylinder, and including a swivel head, wherein the pressure pad is arranged, said swivel head being swivellable about a swivel axis extending parallel to the axes of the printing-press cylinders from a pressure position for the cleaning cloth on the blanket cylinder to a pressure position for the cleaning cloth on the impression cylinder and, in reverse, from a pressure position on the impression cylinder to a pressure position on the blanket; cylinder, the swivel axis of said swivel head being spaced substantially equidistantly from the circumference of both the blanket and the impression cylinders, respectively.

8. Cleaning device according to claim 1, wherein the printing press has a press frame formed with side walls, and including bearings for the clean-cloth spindle and the soiled-cloth spindle arranged in the side walls of the press frame.

* * * * *